US011815282B2

(12) United States Patent
Xu et al.

(10) Patent No.: US 11,815,282 B2
(45) Date of Patent: Nov. 14, 2023

(54) AIR CONDITIONER AND CONTROL METHOD THEREFOR

(71) Applicants: Qingdao Haier Air-conditioning Electronic Co., Ltd, Qingdao (CN); Haier Smart Home Co., Ltd., Qingdao (CN)

(72) Inventors: Wei Xu, Qingdao (CN); Changjian Wei, Qingdao (CN); Zhiwei Yang, Qingdao (CN); Bo Ding, Qingdao (CN); Guosheng Tang, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 395 days.

(21) Appl. No.: 17/256,761

(22) PCT Filed: Sep. 26, 2019

(86) PCT No.: PCT/CN2019/108265
§ 371 (c)(1),
(2) Date: Dec. 29, 2020

(87) PCT Pub. No.: WO2020/211297
PCT Pub. Date: Oct. 22, 2020

(65) Prior Publication Data

US 2021/0285683 A1 Sep. 16, 2021

(30) Foreign Application Priority Data

Apr. 17, 2019 (CN) ..... 201910310284.7

(51) Int. Cl.
*F24F 11/89* (2018.01)
*F24F 11/58* (2018.01)
(Continued)

(52) U.S. Cl.
CPC ..... *F24F 11/89* (2018.01); *F24F 1/06* (2013.01); *F24F 1/48* (2013.01); *F24F 1/56* (2013.01); *F24F 11/58* (2018.01)

(58) Field of Classification Search
CPC .... F24F 11/89; F24F 11/58; F24F 1/06; F24F 1/48; F24F 1/56; F24F 1/58
See application file for complete search history.

(56) References Cited

FOREIGN PATENT DOCUMENTS

CN 205717616 U 11/2016
CN 106322573 A 1/2017
(Continued)

OTHER PUBLICATIONS

Garstats (https://garstats.wordpress.com/2017/11/28/trimmed-means/, 2017). (Year: 2017).*
(Continued)

*Primary Examiner* — Schyler S Sanks
(74) *Attorney, Agent, or Firm* — Maier & Maier, PLLC

(57) ABSTRACT

An air conditioner, including an outdoor unit and a control system, an air outlet being provided at the top of a box body of the outdoor unit. The air conditioner further includes a snow hood in communication with the air outlet, a rotation driving device connected to the snow hood, and a wind direction detection device provided on the box body. The snow hood is rotatably provided on the top of the box body, and the rotation driving device and the wind direction detection device both communicate with the control system.

13 Claims, 6 Drawing Sheets

(51) Int. Cl.

| | |
|---|---|
| ***F24F 1/06*** | (2011.01) |
| ***F24F 1/48*** | (2011.01) |
| ***F24F 1/56*** | (2011.01) |

(56) References Cited

FOREIGN PATENT DOCUMENTS

| | | | | |
|---|---|---|---|---|
| CN | 205860270 | U | | 1/2017 |
| CN | 207422499 | U | * | 5/2018 |
| CN | 207422499 | U | | 5/2018 |
| CN | 108844146 | A | * | 11/2018 |
| CN | 108844146 | A | | 11/2018 |
| CN | 110107962 | A | | 8/2019 |
| JP | 2000193302 | A | * | 7/2000 |
| JP | 2003-214660 | A | | 7/2003 |
| KR | 2003-0012674 | A | | 2/2003 |

OTHER PUBLICATIONS

CN207422499U Translation (Year: 2018).*
CN108844146A Translation (Year: 2018).*
JP2000193302A Translation (Year: 2000).*
International Search Report dated Jan. 14, 2020 in corresponding International application No. PCT/CN2019/108265; 5 pages.

* cited by examiner

AIR CONDITIONER AND CONTROL METHOD THEREFOR

FIELD

The present disclosure belongs to the technical field of air conditioners, and specifically provides an air conditioner and a control method therefor.

BACKGROUND

An outdoor unit of an air conditioner generally includes a top air outlet type and a side air outlet type. For an air conditioner outdoor unit of the top air outlet type, when it snows in winter, snowflakes will enter an interior of the outdoor unit from the air outlet of the air conditioner outdoor unit of the top air outlet type, and it is easy for snow to accumulate on components such as a fan and the like. When the snow accumulates to a certain extent, it will hinder the normal operation of the fan, causing unsmooth internal air circulation of the outdoor unit of the air conditioner, which will reduce the working efficiency of the air conditioning system, and which may cause a safety accident after the snow melts.

In the prior art, a fixed snow hood is usually used. Specifically, the snow hood is fixed on a top of a box of the outdoor unit of the air conditioner, an outlet of the snow hood faces a certain direction, and the outlet direction cannot be adjusted. Although this kind of snow hood can play a certain role of shielding wind and snow, it also has certain limitations. Because the wind direction is constantly changing and the outlet direction of the fixed snow hood is fixed, although the wind and snow in a certain direction can be blocked, once the wind direction changes, the wind and snow may backflow into the interior of the outdoor unit of the air conditioner through the snow hood. Then, the snow hood loses its function of shielding wind and snow. For example, the document with the application number 201721509516.4 discloses a snow hood for an outdoor unit of an air conditioner, and an air conditioner, wherein the air conditioner includes a housing, a snow hood, and an adjustment device for adjusting a ventilation amount of the snow hood. Since the snow hood is fixed at the air outlet of the box of the air conditioner outdoor unit, and the outlet direction of the snow hood faces a certain direction fixedly and cannot be changed, the adjustment device can only be used to adjust the magnitude of ventilation amount of the snow hood, so it is impossible for the snow hood to adjust the outlet direction of the snow hood according to the current wind direction, and there is still a situation of wind and snow backflow, which will affect the ventilation amount of the air conditioning device. Therefore, the fixed snow hood cannot cope with the complex and constantly changing wind direction and the whirling wind between buildings, and when an included angle between the outlet direction of the snow hood and the wind direction is too large, the flowing air will form a positive pressure at the outlet of the snow hood, causing snowflakes to flow back into the interior of the outdoor unit through the snow hood with the flowing air and damage the outdoor unit of the air conditioner.

Accordingly, there is a need in the art for a new air conditioner and a control method therefor to solve the above problem.

SUMMARY

In order to solve the above problem in the prior art, that is, to solve the problem that the outlet direction of the snow hood of existing air conditioner outdoor units is fixed and cannot be adjusted with the change of the wind direction, which may cause backflow of the wind and snow and affect the ventilation amount, the present disclosure provides an air conditioner, wherein the air conditioner includes an outdoor unit and a control system, and a top of a box of the outdoor unit is provided with an air outlet; the air conditioner further includes a snow hood in communication with the air outlet, a rotation driving device connected with the snow hood, and a wind direction detection device arranged on the box, wherein the snow hood is rotatably arranged on the top of the box, and the rotation driving device and the wind direction detection device both communicate with the control system.

In a preferred technical solution of the above air conditioner, the rotation driving device includes a drive motor and a transmission mechanism connected with an output end of the drive motor, wherein the transmission mechanism is connected with the snow hood, the drive motor communicates with the control system, and the drive motor is capable of driving the transmission mechanism to rotate the snow hood.

In a preferred technical solution of the above air conditioner, the transmission mechanism includes a gear and a ring rack that mesh with each other, wherein the gear is connected with the output end of the drive motor, and the ring rack is arranged on the snow hood.

In a preferred technical solution of the above air conditioner, the ring rack is arranged on an inner side of the snow hood.

In a preferred technical solution of the above air conditioner, a base is arranged on the top of the box, and the snow hood is rotatably arranged on the base.

In a preferred technical solution of the above air conditioner, a support bearing is provided between the snow hood and the base, and the support bearing is capable of supporting the snow hood and allows the snow hood to rotate relative to the base.

In a preferred technical solution of the above air conditioner, an axis of the support bearing is arranged in parallel with an upper surface of the base.

In a preferred technical solution of the above air conditioner, the air conditioner further includes a tensioning device provided on the base, and the tensioning device is capable of limiting a lateral movement of the snow hood.

In a preferred technical solution of the above air conditioner, the tensioning device includes at least two tensioning mechanisms which jointly limit the lateral movement of the snow hood, wherein the tensioning mechanism includes a connecting member connected with the base and a tensioning wheel connected with the connecting member, and the tensioning wheel abuts against the snow hood.

In addition, the present disclosure also provides a control method for an air conditioner; the air conditioner includes an outdoor unit and a control system, and a top of a box of the outdoor unit is provided with an air outlet; the air conditioner further includes a snow hood in communication with the air outlet, a rotation driving device connected with the snow hood, and a wind direction detection device arranged on the box, wherein the snow hood is rotatably arranged on the top of the box, and the rotation driving device and the wind direction detection device both communicate with the control system; and the control method includes: obtaining a wind direction and an outlet direction of the snow hood; and selectively adjusting the outlet direction of the snow hood according to the wind direction and the outlet direction of the snow hood.

In a preferred technical solution of the above control method, the step of "selectively adjusting the outlet direction of the snow hood according to the wind direction and the outlet direction of the snow hood" includes: calculating an included angle between the wind direction and the outlet direction of the snow hood; judging whether the included angle is within a preset angle range; and selectively adjusting the outlet direction of the snow hood according to the judgment result.

In a preferred technical solution of the above control method, the step of "selectively adjusting the outlet direction of the snow hood according to the judgment result" includes: adjusting the outlet direction of the snow hood if the included angle is not within the preset angle range.

In a preferred technical solution of the above control method, the step of "selectively adjusting the outlet direction of the snow hood according to the judgment result" includes: not adjusting the outlet direction of the snow hood if the included angle is within the preset angle range.

In a preferred technical solution of the above control method, the step of "obtaining a wind direction" includes: obtaining wind direction data once every second preset time within a first preset time; and calculating an average value of all the wind direction data to obtain the wind direction.

In a preferred technical solution of the above control method, the step of "obtaining a wind direction" includes: obtaining wind direction data once every second preset time within a first preset time; removing maximum and minimum values of all the wind direction data; and calculating an average value of the remaining wind direction data to obtain the wind direction.

It can be understood by those skilled in the art that in the preferred technical solutions of the present disclosure, the air conditioner includes an outdoor unit and a control system, and a top of a box of the outdoor unit is provided with an air outlet; the air conditioner further includes a snow hood in communication with the air outlet, a rotation driving device connected with the snow hood, and a wind direction detection device arranged on the box, wherein the snow hood is rotatably arranged on the top of the box, and the rotation driving device and the wind direction detection device both communicate with the control system. The wind direction detection device can detect the change of the wind direction in the current period and send it to the control system. The control system sends an action instruction to the rotation driving device according to wind direction data in the current period, so that the snow hood makes corresponding adjustments to keep the outlet direction of the snow hood and the wind direction consistent or keep them within a relatively small included angle. With this arrangement, on one hand, backflow of the wind and snow can be effectively prevented, so that the ventilation amount can be increased to a certain extent; on the other hand, the flow of wind will form a negative pressure at the outlet of the snow hood, and the smaller the included angle between the wind direction and the outlet direction of the snow hood is, the greater the negative pressure will be, and the better the achieved ventilation effect will be, which improves the heating efficiency and stability of the air conditioner.

Further, the rotation driving device includes a drive motor and a transmission mechanism, an output end of the drive motor is connected with the transmission mechanism, the transmission mechanism is connected with the snow hood, and the drive motor communicates with the control system to provide power for the transmission mechanism so that the outlet direction of the snow hood is rotated to a target direction. An automatic adjustment can be realized for the snow hood without human intervention, thus having a high degree of automation and enabling a remote control.

Further, the transmission mechanism includes a gear and a ring rack that mesh with each other, wherein the gear is connected with the output end of the drive motor, and the ring rack is arranged on the snow hood. With this arrangement, the transmission mode is simple, the transmission is stable, the arrangement is convenient, and the efficiency is high.

Further, the ring rack is arranged on the inner side of the snow hood, so that the snow hood can protect the ring rack to a certain extent, thus preventing external rain, snow and dust from corroding the ring rack, prolonging the service life of the air conditioner, extending the maintenance cycle of the air conditioner, and thereby improving the stability and reliability of the air conditioner.

Further, a base is arranged on the top of the box, and the snow hood is rotatably arranged on the base. In a season when the snow hood is not required, the snow hood can be detached from the base, and in a season when the snow hood is required, the snow hood can be installed again to realize the reuse of the snow hood. Quick installation and detachment of the snow hood can be realized.

Further, a support bearing is provided between the snow hood and the base, and the support bearing is capable of supporting the snow hood and allows the snow hood to rotate relative to the base. The support bearing is used as a load-bearing support and a rotating shaft of the snow hood, so that the snow hood receives a stable force during the working process. Even if the snow hood is subjected to wind in different directions, the snow hood can still rotate smoothly to adjust its outlet direction, so as to keep the outlet direction of the snow hood and the wind direction consistent or keep them within a relatively small included angle.

Further, the axis of the support bearing is arranged in parallel with the upper surface of the base, the support bearing can roll on the base, and the support bearing in the snow hood serves as the rotating shaft of the snow hood, which improves the stability of the snow hood during the rotation process, reduces the friction between the snow hood and the base, reduces a rotation resistance to the snow hood, reduces the working load of the drive motor, and lowers the cost.

Further, the air conditioner also includes a tensioning device arranged on the base and capable of limiting a lateral movement of the snow hood, and a tensioning wheel cooperates with the support bearing to provide a horizontal constraint for the snow hood to ensure that the snow hood has strong wind-resistant performance and will not shift laterally under the influence of wind, thereby improving the stability and reliability of the air conditioner.

Further, the tensioning device includes at least two tensioning mechanisms which jointly limit the lateral movement of the snow hood, wherein the tensioning mechanism includes a connecting member connected with the base and a tensioning wheel connected with the connecting member, and the tensioning wheel abuts against the snow hood. By arranging multiple tensioning wheels on the snow hood respectively, the snow hood can still be firmly connected with the base under wind loads in different directions, and the snow hood will not shift laterally. Moreover, there is rolling friction between the tensioning wheels and the snow hood, which will not affect the rotation of the snow hood, thereby improving the adaptability and stability of the air conditioner.

In addition, on the basis of the above technical solutions, the present disclosure also provides a control method for an air conditioner. Due to the use of the above air conditioner, the technical effects of the above air conditioner are further provided, and as compared with the snow hood before the improvement, the outlet direction of the snow hood of the present disclosure can be automatically adjusted according to the change of the wind direction; that is, the wind direction detection device detects the wind direction data and transmits it to the control system, and the control system performs processing and calculation on the data (an average value of the wind direction data is calculated; preferably, maximum and minimum values of the wind direction data are removed and then an average value of the remaining wind direction data is calculated) so that the wind direction in the current period is obtained. The control system compares the included angle between the outlet direction of the snow hood and the wind direction with a preset angle of the control system, and selectively adjusts the outlet direction of the snow hood according to the judgment result. When applied with this control method, the snow hood improves the accuracy of wind direction detection, can cope with the complex and constantly changing wind direction, and can prevent the wind and snow from entering the interior of the outdoor unit of the air conditioner through backflow from the outlet of the snow hood, thereby increasing the ventilation amount to a certain extent, and further improving the heating efficiency of the air conditioner.

DETAILED DESCRIPTION

Figure 1:
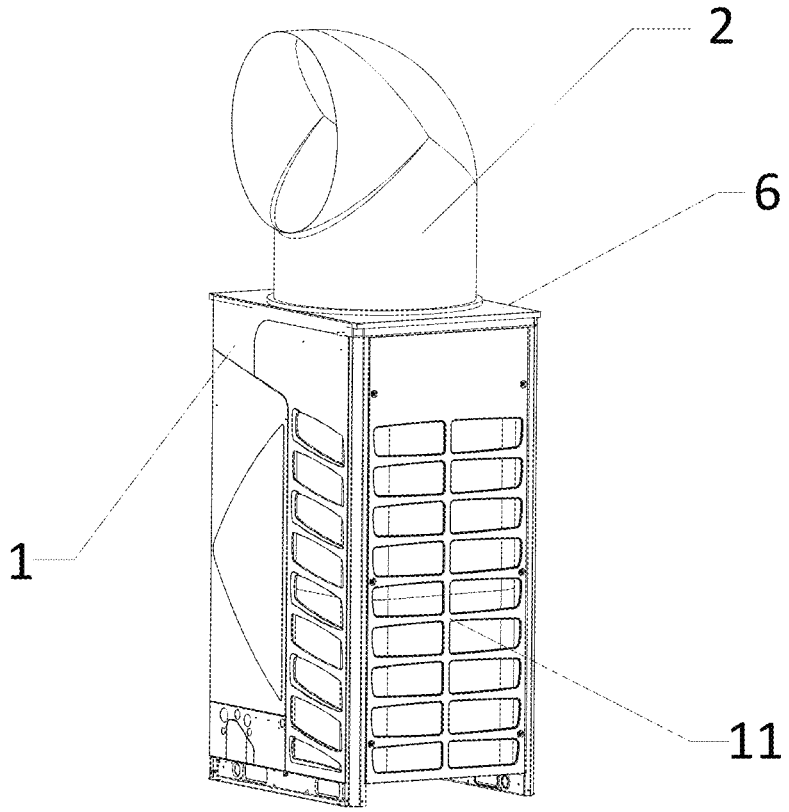
FIG. 1 is a first schematic structural view of an air conditioner of the present disclosure.

It should be understood by those skilled in the art that these embodiments are only used to explain the technical principles of the present disclosure, and are not intended to limit the scope of protection of the present disclosure.

It should be noted that in the description of the present disclosure, directional or positional relationships indicated by terms such as "upper", "lower", "inner" and "outer" are based on the directional or positional relationships shown in the drawings. They are merely used for the convenience of description, and do not indicate or imply that the device or element involved must have a specific orientation, or be configured or operated in a specific orientation, and therefore they should not be construed as limiting the present disclosure. In addition, terms "first", "second" and "third" are used for descriptive purpose only, and should not be construed as indicating or implying relative importance.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

In view of the problem pointed out in the "BACKGROUND OF THE INVENTION" that the outlet direction of the snow hood of existing air conditioner outdoor units is fixed and cannot be adjusted with the change of the wind direction, which may cause backflow of the wind and snow and affect the ventilation amount, the present disclosure provides an air conditioner and a control method therefor, aiming at enabling the outlet direction of the snow hood of the air conditioner outdoor unit to be adjusted according to the wind direction so that the outlet direction of the snow hood and the wind direction are kept consistent or kept within a relatively small included angle, thereby preventing backflow of the wind and snow and enabling the air conditioner to achieve the best ventilation effect.

Specifically, as shown in FIGS. 1 to 6, the air conditioner of the present disclosure includes an outdoor unit 1 and a control system 3, and a top of a box 11 of the outdoor unit is provided with an air outlet; the air conditioner further includes a snow hood 2 in communication with the air outlet, a rotation driving device 4 connected with the snow hood 2, and a wind direction detection device 5 arranged on the box 11, wherein the snow hood 2 is rotatably arranged on the top of the box 11, and the rotation driving device 4 and the wind direction detection device 5 both communicate with the control system 3. The air outlet of the box 11 of the outdoor unit of the air conditioner is connected with the snow hood 2, and the air inside the box 11 enters the snow hood 2 through the air outlet, and then is discharged out through the snow hood 2. The wind direction detection device 5 is configured to detect outdoor wind direction, and send detected wind direction data to the control system 3. After the control system 3 analyzes and processes the wind direction data, it sends an instruction to the rotation driving device 4 to make the snow hood 2 adjust accordingly so that the outlet direction of the snow hood 2 and the wind direction are kept consistent or kept within a relatively small included angle and that a negative pressure is formed at the outlet of the snow hood 2, thereby preventing backflow of the wind and snow and achieving the best ventilation effect. The control system 3 of the present disclosure can be used to control all executive elements of the air conditioner to realize all the control functions of the air conditioner. In addition, in the present disclosure, a wired connection communication mode may be used for the control system 3, the rotation driving device 4 and the wind direction detection device 5, or a wireless connection (such as Bluetooth, wifi) communication mode may be used. In practical applications, those skilled in the art may flexibly set the specific communication mode of the control system 3, the rotation driving device 4 and the wind direction detection device 5 according to the specific structure of the outdoor unit of the air conditioner. In addition, in the present disclosure, the snow hood 2 may have a box shape, or a cylindrical shape, or other shapes. Those skilled in the art may flexibly set the shape of the snow hood 2 in practical applications. The adjustments and changes to the shape of the snow hood 2 should be covered within the scope of protection of the present disclosure.

In the present disclosure, the wind direction detection device 5 may be arranged either on the top of the box 11 or on the side of the box 11. Those skilled in the art may flexibly set the specific position of the wind direction detection device 5 in practical applications, as long as the wind direction detection device 5 can detect the outdoor wind direction. Such adjustments and changes to the specific position of the wind direction detection device 5 do not constitute limitations to the present disclosure, and should be covered within the scope of protection of the present disclosure. In addition, the wind direction detection device 5 may be a wind direction sensor, or other devices for detecting the wind direction. Those skilled in the art may flexibly select the structure and type of the wind direction detection device 5 in practical applications, as long as the wind direction detection device 5 can convert the wind direction data into an electrical signal and transmit the electrical signal to the control system 3.

Figure 2:
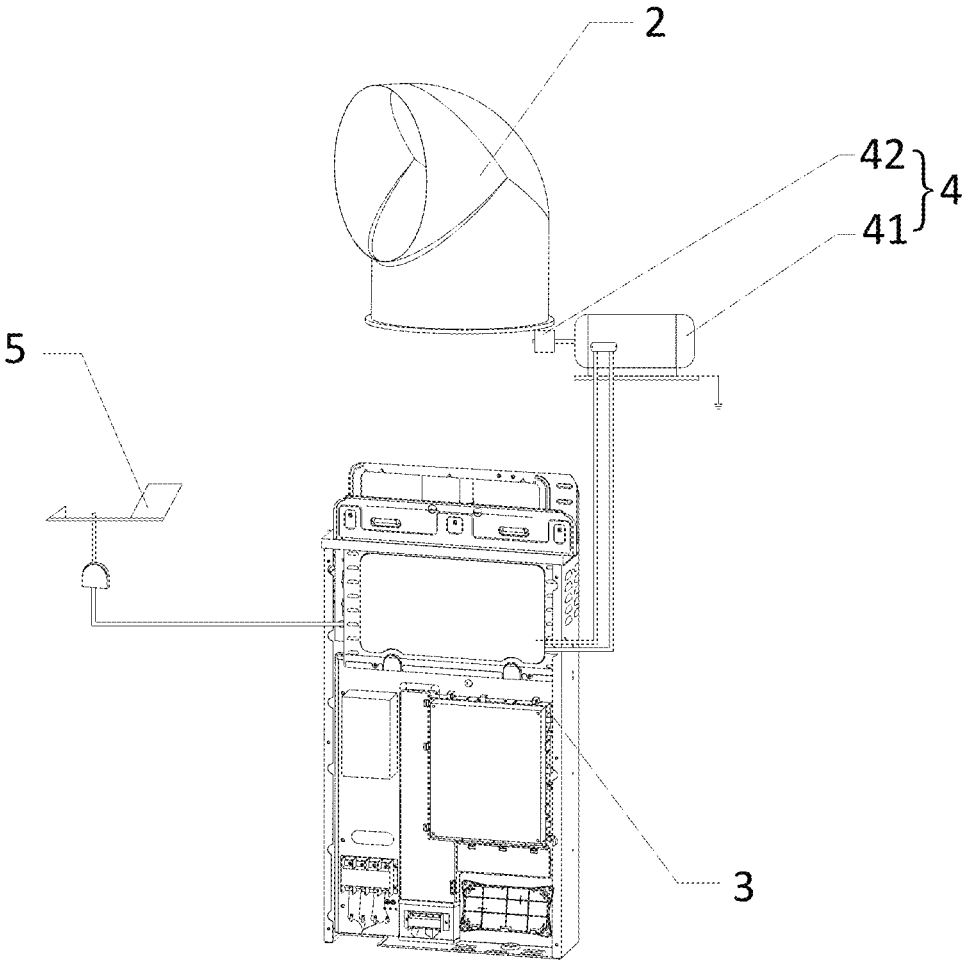
FIG. 2 is a second schematic structural view of the air conditioner of the present disclosure.

Preferably, as shown in FIG. 2, the rotation driving device 4 includes a drive motor 41 and a transmission mechanism 42 connected with an output end of the drive motor 41, wherein the transmission mechanism 42 is connected with the snow hood 2, the drive motor 41 communicates with the control system 3 (the drive motor 41 may be in wired connection or wireless connection with the control system 3), and the drive motor 41 provides the transmission mechanism 42 with power to rotate the snow hood 2. The drive motor 41 in the rotation driving device 4 may be a DC motor or an AC motor, and may be a servo motor or a stepper motor. Those skilled in the art may flexibly select the type of the drive motor 41 according to specific working conditions in practical applications. The transmission mechanism 42 is connected with the snow hood 2, wherein the transmission mechanism 42 may be connected with an inner side of the snow hood 2, or may be connected with an outer side of the snow hood 2; if the transmission mechanism 42 is arranged on the inner side of the snow hood 2, it can protect the transmission mechanism 42 from being eroded by rain, snow and dust, and the service life of the transmission mechanism 42 is prolonged; and if the transmission mechanism 42 is arranged on the outer side of the snow hood 2, it will not occupy the internal space of the snow hood 2, which is convenient for the arrangement and subsequent maintenance of the transmission mechanism 42. Those skilled in the art may select the position and arrangement of the transmission mechanism 42 according to the specific conditions in practical applications. Such changes to the position and arrangement of the transmission mechanism 42 do not constitute limitations to the present disclosure, and should be covered within the scope of protection of the present disclosure.

Figure 3:
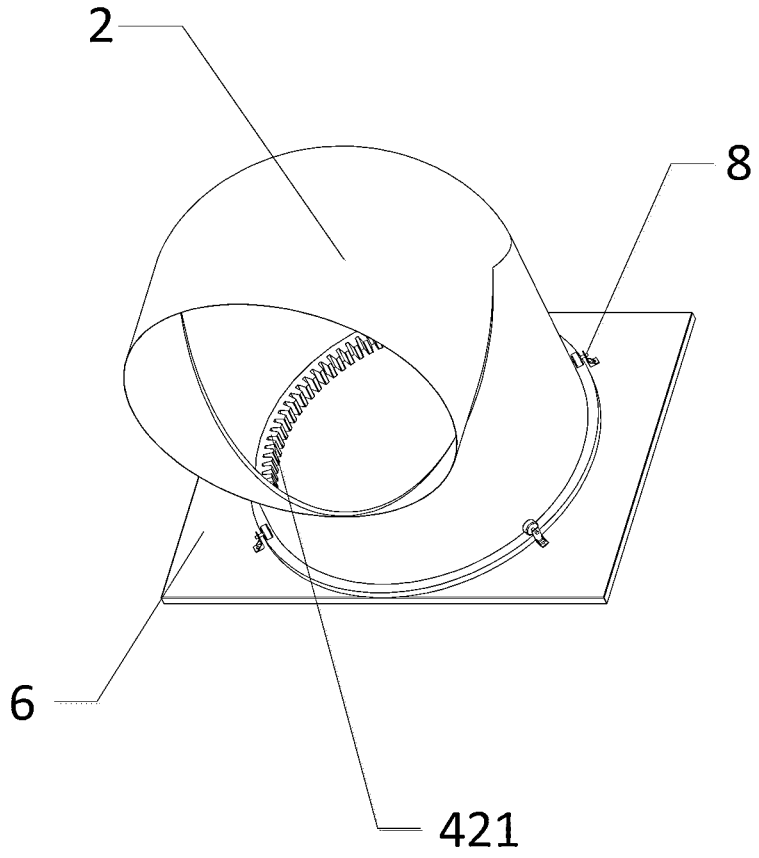
FIG. 3 is a first schematic structural view of a snow hood of the present disclosure.
Figure 5:
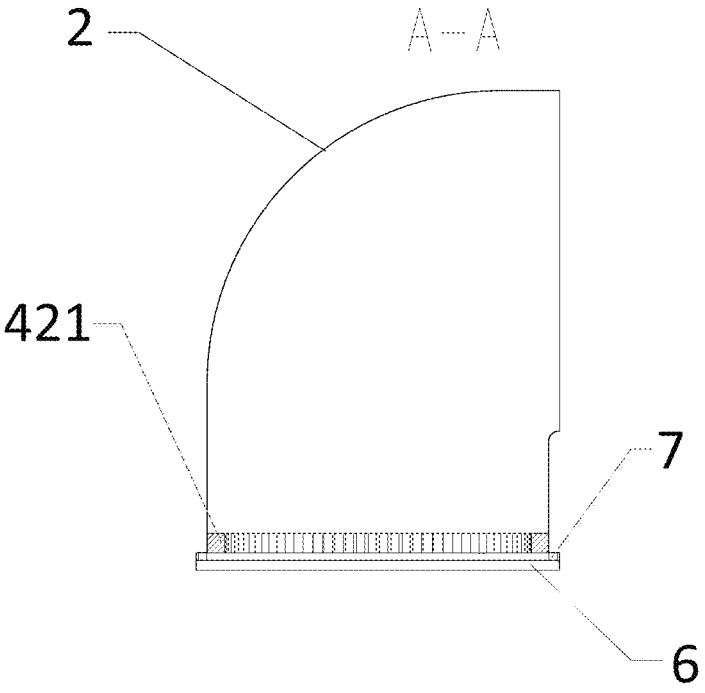
FIG. 5 is a cross-sectional view taken along line A-A in FIG. 4.

Preferably, a structure in which a gear meshes with a ring rack 421 is adopted for the transmission mechanism 42, and the ring rack 421 is arranged on the inner side (just as shown in FIGS. 3 and 5) or the outer side of the snow hood 2. The present disclosure will be described in detail by only using an example in which the ring rack 421 is arranged on the inner side the snow hood 2. The gear is connected with an output shaft of the drive motor 41. When the drive motor 41 is operating, it can drive the gear to rotate so that the gear can drive the ring rack 421 to rotate under the action of meshing, and the rotation of the ring rack 421 can drive the snow hood 2 to rotate, thereby achieving the object of adjusting the outlet direction of the snow hood 2. Of course, a combined structure of worm-and-worm wheel or a combined structure of ball-and-screw may also be adopted for the transmission mechanism 42. Those skilled in the art may flexibly set the structure and position of the transmission mechanism 42 according to specific needs in practical applications, as long as the transmission mechanism 42 can realize the rotation of the snow hood 2 under the driving of the drive motor 41, so as to achieve the object of adjusting the outlet direction of the snow hood 2.

Preferably, as shown in FIGS. 3 to 6, the ring rack 421 is arranged on the inner side of the snow hood 2. The ring rack 421 may be arranged on the inner side of the snow hood 2 through detachable connection (such as by screw, snap-fit, adhesive, magnetic adsorption connection, etc.), or the ring rack 421 may also be fixed on the inner side of the snow hood 2 through non-detachable connection such as welding. Those skilled in the art may flexibly set the way of connecting the ring rack 421 and the snow hood 2 in practical applications, as long as the ring rack 421 can be arranged on the inner side of the snow hood 2.

Preferably, as shown in FIGS. 1 to 6, a base 6 is provided on the top of the box 11. On one hand, the base 6 can strengthen the top of the box 11 to a certain extent; on the other hand, the base 6 serves as a load-bearing platform for the snow hood 2. The weight of the snow hood 2 is dispersed and transmitted to the box 11 through the base 6, which improves the stability and reliability of the box 11; and the snow hood 2 can rotate relative to the base 6 to achieve the object of adjusting the outlet direction of the snow hood 2. In practical applications, the base 6 may be arranged integrally with the box 11 or may be fixedly connected with the box 11.

Figure 6:
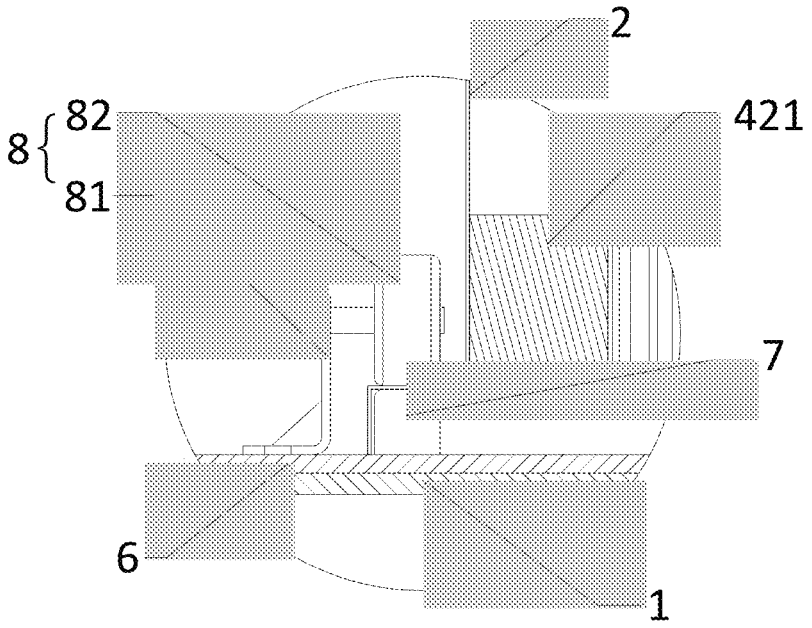
FIG. 6 is a third schematic structural view of the air conditioner of the present disclosure.

Preferably, as shown in FIGS. 5 and 6, a support bearing 7 is provided between the snow hood 2 and the base 6, namely, the snow hood 2 and the base 6 are in non-direct contact, and the support bearing 7 not only serves as a support body for the snow hood 2 to provide a support force for the snow hood 2, but also is used as a rotating shaft during the rotation of the snow hood 2 to reduce a rotation resistance to the snow hood 2 and reduce a working load of the drive motor 41. Therefore, the power requirement for the rotation of the snow hood 2 can be met by selecting a low-power drive motor 41, which reduces the cost. In practical applications, there may be one support bearing, or more than one support bearings 7. When there is one support bearing 7, the snow hood 2 may be supported by the support bearing 7 together with other support members.

Preferably, as shown in FIG. 6, an axis of the support bearing 7 is arranged in parallel with an upper surface of the base 6. With this arrangement, the support bearing 7 can roll on the base 6 and serve as the rotating shaft of the snow hood 2, thereby reducing the working load of the drive motor 41 and also providing support for the snow hood 2. The support bearing 7 may be a ball bearing, a roller bearing, or other types of bearings. Those skilled in the art may flexibly set the specific type of the support bearing 7 in practical applications, as long as the bearing can play a supporting role and can be used as the rotating shaft of the snow hood 2 during the rotation process.

Preferably, the air conditioner further includes a tensioning device provided on the base 6, which can limit a lateral movement of the snow hood 2 and ensure that the snow hood 2 will not shift laterally when blown by wind in different directions. In a possible situation, the tensioning device may abut against an outer side wall of the snow hood 2. In this situation, the tensioning device can limit the snow hood 2 laterally. Of course, in a more preferred situation, a bottom of the snow hood 2 has a boss, and the tensioning device abuts against a top of the boss. With this arrangement, the snow hood 2 can be limited both laterally and vertically by the tensioning device, i.e., realizing horizontal and vertical limiting.

Figure 4:
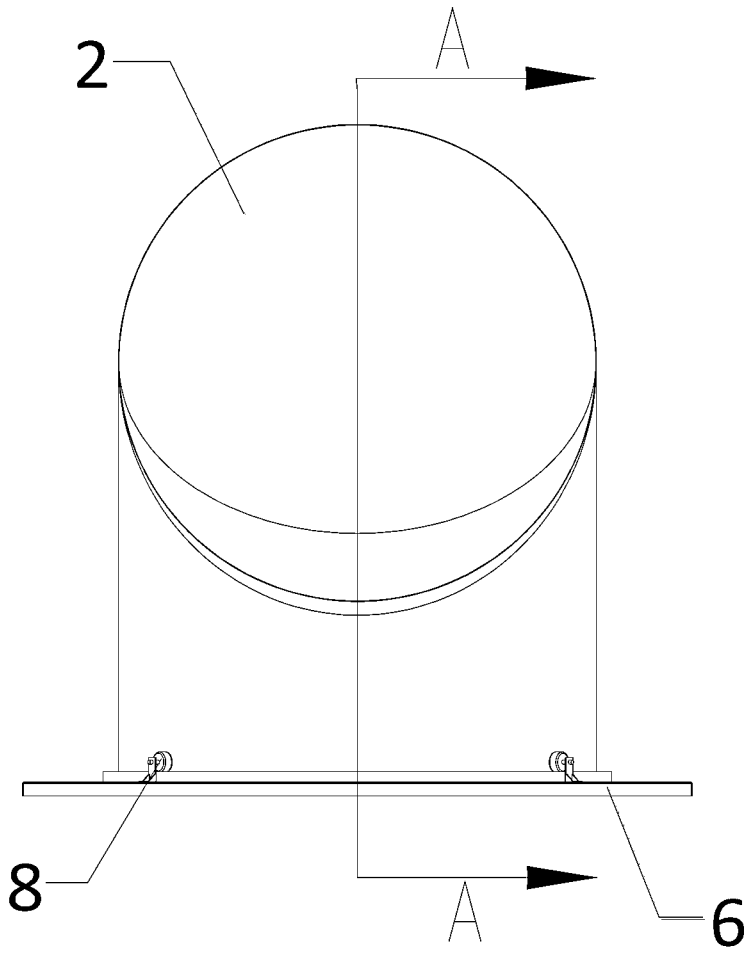
FIG. 4 is a second schematic structural view of the snow hood of the present disclosure.

Preferably, the tensioning device includes at least two tensioning mechanisms 8 which jointly limit the lateral movement of the snow hood 2, wherein the tensioning mechanism 8 includes a connecting member 81 connected with the base 6, and a tensioning wheel 82 connected with the connecting member 81, and the tensioning wheel 82 abuts against the snow hood 2. The tensioning wheel 82 can abut against the outer side wall of the snow hood 2. In this situation, all the tensioning mechanisms 8 limit the snow hood 2 laterally. Of course, the tensioning wheel 82 may also abut against the top of the aforementioned boss of the snow hood 2 (just as shown in the structure of FIGS. 3, 4 and 6); in this situation, all the tensioning mechanisms 8 provide lateral and vertical limiting for the snow hood 2. The number of the tensioning mechanisms 8 may be two, three, or four. In practical applications, those skilled in the art may set the number of the tensioning mechanisms 8 according to specific conditions. The changes to the number of the tensioning mechanisms 8 do not constitute limitations to the present disclosure, and should be covered within the scope of protection of the present disclosure. In addition, the tensioning wheel 82 may be rotatably arranged with the connecting member 81. In this structure, a part of the connecting member 81 may be set as a rotating shaft, and then the tensioning wheel 82 can be sleeved over the rotating shaft. Of course, it is also possible to configure the tensioning wheel 82 itself to be rotatable. In this structure, the tensioning wheel 82 may include a wheel and a bracket shaft, the wheel is sleeved over the bracket shaft, and the bracket shaft is connected with the connecting member 81. In the present disclosure, the connecting member 81 is preferably an elastic connecting member. With this arrangement, the snow hood 2 can be elastically limited.

Figure 7:
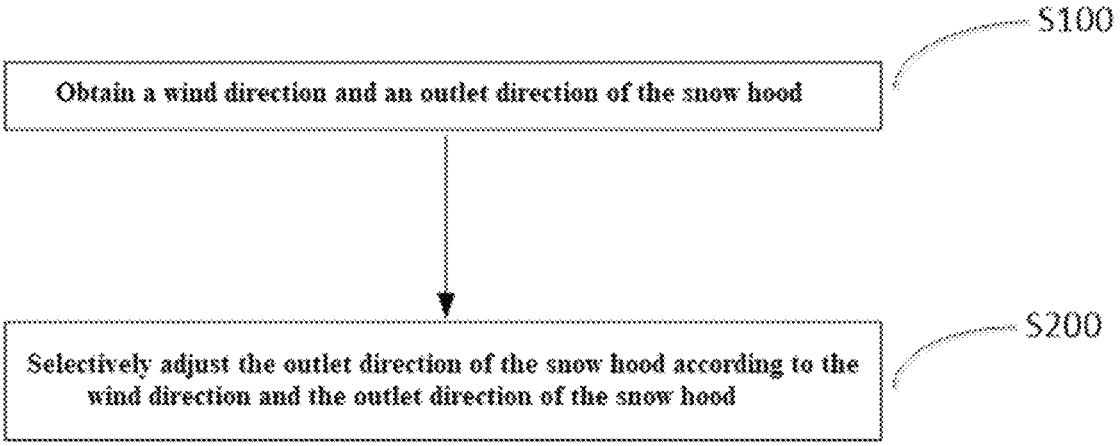
FIG. 7 is a flowchart of a control method of the present disclosure.

In addition, the present disclosure also provides a control method for an air conditioner. As shown in FIG. 7, the control method includes:

S100: obtaining a wind direction and an outlet direction of the snow hood 2; and S200: selectively adjusting the outlet direction of the snow hood 2 according to the wind direction and the outlet direction of the snow hood 2.

In step S100, the way of obtaining the wind direction may specifically be obtaining the wind direction in real time, or may be obtaining multiple wind direction data within a period of time, then calculating an average value of the wind direction data, and using the average value as the wind direction. Those skilled in the art may flexibly set the way of obtaining the wind direction in practical applications. Such adjustments and changes to the way of obtaining the wind direction do not constitute limitations to the present disclosure, and should be covered within the scope of protection of the present disclosure. In a preferred situation, the step of "obtaining a wind direction" includes: obtaining wind direction data once every second preset time within a first preset time; and calculating an average value of all the wind direction data to obtain the wind direction. That is, multiple wind direction data are obtained at the same time interval within the first preset time, an average value of all the obtained wind direction data is calculated, and the average value is taken as the wind direction; namely, the wind direction detection device 5 sends the average value to the control system 3. Through this setting, the value of the wind direction can be made more accurate, thereby ensuring that the snow hood 2 can be adjusted to the most suitable angle. In a more preferred situation, the step of "obtaining a wind direction" includes: obtaining wind direction data once every second preset time within a first preset time; removing maximum and minimum values of all the wind direction data; and calculating an average value of the remaining wind direction data to obtain the wind direction. As compared with the previous situation, by removing the maximum and minimum values of all the wind direction data, the accuracy of the value of the wind direction can be further improved, so that the wind direction of the snow hood 2 can be adjusted more accurately.

In the above two situations, the first preset time may be 30 minutes, and the second preset time may be 5 minutes, that is, the wind direction detection device 5 detects the wind direction once every 5 minutes and sends the wind direction data to the control system 3; when the total time reaches 30 minutes, the control system 3 collects all the wind direction data obtained, and then performs subsequent calculations. Those skilled in the art may flexibly adjust the first preset time and the second preset time according to specific conditions in practical applications. Such adjustments to the first preset time and the second preset time do not constitute limitations to the present disclosure, and should be covered within the scope of protection of the present disclosure.

In the foregoing, step S200 includes: calculating an included angle between the wind direction and the outlet direction of the snow hood 2; judging whether the included angle is within a preset angle range; and selectively adjusting the outlet direction of the snow hood 2 according to the judgment result. Specifically, the step of "selectively adjusting the outlet direction of the snow hood 2 according to the judgment result" includes: adjusting the outlet direction of the snow hood 2 if the included angle is not within the preset angle range; and not adjusting the outlet direction of the snow hood 2 if the included angle is within the preset angle range. In other words, if the included angle is not within the preset angle range, it means that the included angle between the wind direction and the outlet direction of the snow hood 2 is large. In this situation, a positive pressure is likely to be formed at the outlet of the snow hood 2 and it is easy to cause backflow of wind and snow and a low wind-blowing efficiency, so the outlet direction of the snow hood 2 should be adjusted in time. If the included angle is within the preset angle range, it means that the included angle between the wind direction and the outlet direction of the snow hood 2 is not large. In this situation, backflow of wind and snow will not happen and a low wind-blowing efficiency will not be caused. After repeated experiments, analysis and comparison, the inventor has found that the preset angle range is preferably set between −5° and 5°, that is, when the included angle between the outlet direction of the snow hood 2 and the wind direction is larger than or equal to 5° or smaller than or equal to −5°, the outlet direction of the snow hood 2 should be adjusted in time to keep the included angle between the outlet direction of the snow hood 2 and the wind direction between −5° and 5°. Of course, in practical applications, the preset angle range may also be between −8° and 8°, or between −10° and 10°. Those skilled in the art may flexibly set the preset angle range in practical applications. Such adjustments to the preset angle range do not constitute limitations to the present disclosure, and should be covered within the scope of protection of the present disclosure.

The work flow of the present disclosure may be described as follows: after the air conditioner is installed, a relative position of the snow hood 2 and the wind direction detection device 5 is calibrated first, so that the outlet direction of the snow hood 2 is consistent with a marking direction of the control system 3; the wind direction detection data is cleared, and after calibration, the air conditioner starts to operate. The wind direction detection device 5 detects the change of wind direction in the current period, and transmits the wind direction data to the control system 3. The control system 3 calculates, analyzes and processes the wind direction data, determines the wind direction, determines the current outlet direction of the snow hood 2, and calculates the amount of rotation by which the snow hood 2 needs to adjust according to the wind direction and the outlet direction of the snow hood 2. The control system 3 gives an instruction to the drive motor 41, and the drive motor 41 rotates the snow hood 2 through the transmission mechanism 42 so that the outlet direction of the snow hood 2 and the wind direction are kept consistent or kept within a relatively small included angle.

Hitherto, the technical solutions of the present disclosure have been described in conjunction with the preferred embodiments shown in accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. An air conditioner, comprising: an outdoor unit and a control system, and a top of a box of the outdoor unit being provided with an air outlet;

the air conditioner further comprising a snow hood in communication with the air outlet, a rotation driving device connected with the snow hood, and a wind direction detection device arranged on the box, and wherein the snow hood is rotatably arranged on the top of the box, and the rotation driving device and the wind direction detection device both communicate with the control system, wherein a base is arranged on the top of the box, and the snow hood is rotatably arranged on the base; and wherein a support bearing is provided between the snow hood and the base, and the support bearing is capable of supporting the snow hood and allows the snow hood to rotate relative to the base.

2. The air conditioner according to claim 1, wherein the rotation driving device comprises a drive motor and a transmission mechanism connected with an output end of the drive motor, the transmission mechanism is connected with the snow hood, the drive motor communicates with the control system, and the drive motor is capable of driving the transmission mechanism to rotate the snow hood.

3. The air conditioner according to claim 2, wherein the transmission mechanism comprises a gear and a ring rack that mesh with each other, the gear is connected with the output end of the drive motor, and the ring rack is arranged on the snow hood.

4. The air conditioner according to claim 3, wherein the ring rack is arranged on an inner side of the snow hood.

5. The air conditioner according to claim 1, wherein an axis of the support bearing is arranged in parallel with an upper surface of the base.

6. The air conditioner according to claim 1, further comprising a tensioning device provided on the base, wherein the tensioning device is capable of limiting a lateral movement of the snow hood.

7. The air conditioner according to claim 6, wherein the tensioning device comprises at least two tensioning mechanisms which jointly limit the lateral movement of the snow hood, and wherein the tensioning mechanisms each comprise a connecting member connected with the base and a tensioning wheel connected with the connecting member, and the tensioning wheel abuts against the snow hood.

8. A control method for an air conditioner, the air conditioner comprising an outdoor unit and a control system, and a top of a box of the outdoor unit being provided with an air outlet; wherein the air conditioner further comprises a snow hood in communication with the air outlet, a rotation driving device connected with the snow hood, and a wind direction detection device arranged on the box, and wherein the snow hood is rotatably arranged on the top of the box, and the rotation driving device and the wind direction detection device both communicate with the control system, the control method comprising:

obtaining a wind direction and an outlet direction of the snow hood; and selectively adjusting the outlet direction of the snow hood according to the wind direction and the outlet direction of the snow hood, wherein a base is arranged on the top of the box, and the snow hood is rotatably arranged on the base; and wherein a support bearing is provided between the snow hood and the base, and the support bearing is capable of supporting the snow hood and allows the snow hood to rotate relative to the base.

9. The control method according to claim 8, wherein selectively adjusting the outlet direction of the snow hood according to the wind direction and the outlet direction of the snow hood comprises:

calculating an included angle between the wind direction and the outlet direction of the snow hood;

judging whether the included angle is within a preset angle range; and selectively adjusting the outlet direction of the snow hood according to the judgment result.

10. The control method according to claim 9, wherein selectively adjusting the outlet direction of the snow hood according to the judgment result comprises:

adjusting the outlet direction of the snow hood if the included angle is not within the preset angle range.

11. The control method according to claim 9, wherein selectively adjusting the outlet direction of the snow hood according to the judgment result comprises:

not adjusting the outlet direction of the snow hood if the included angle is within the preset angle range.

12. The control method according to claim 8, wherein obtaining a wind direction comprises:

obtaining wind direction data once every second preset time within a first preset time; and calculating an average value of all the wind direction data to obtain the wind direction.

13. The control method according to claim 8, wherein obtaining a wind direction comprises:

obtaining wind direction data once every second preset time within a first preset time;

removing maximum and minimum values of all the wind direction data; and calculating an average value of the remaining wind direction data to obtain the wind direction.

* * * * *